US008179697B2

(12) United States Patent
Kim et al.

(10) Patent No.: US 8,179,697 B2
(45) Date of Patent: May 15, 2012

(54) CONTROL PANEL ASSEMBLY AND WASHING MACHINE HAVING THE SAME

(75) Inventors: Yeong Man Kim, Suwon-si (KR); Myung Sun Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 341 days.

(21) Appl. No.: 12/461,586

(22) Filed: Aug. 17, 2009

(65) Prior Publication Data

US 2010/0177494 A1 Jul. 15, 2010

(30) Foreign Application Priority Data

Jan. 14, 2009 (KR) ..... 10-2009-0002924

(51) Int. Cl.
*H05K 7/00* (2006.01)

(52) U.S. Cl. ..... 361/837; 312/228

(58) Field of Classification Search ..... 361/837; 312/228

See application file for complete search history.

(56) References Cited

U.S. PATENT DOCUMENTS

| | | | | |
|---|---|---|---|---|
| 4,682,267 | A * | 7/1987 | Magilton | 361/837 |
| 7,752,871 | B2 * | 7/2010 | Cho et al. | 68/12.27 |
| 7,875,816 | B2 * | 1/2011 | Yoon et al. | 200/5 A |
| 2005/0178166 | A1 * | 8/2005 | Kim et al. | 68/12.23 |
| 2007/0125134 | A1 * | 6/2007 | Park | 68/17 R |
| 2007/0180867 | A1 * | 8/2007 | Hur | 68/3 R |
| 2007/0209403 | A1 * | 9/2007 | Byun et al. | 68/3 R |
| 2008/0225016 | A1 * | 9/2008 | Lee | 345/174 |
| 2008/0256984 | A1 * | 10/2008 | Lim et al. | 68/12.23 |
| 2009/0056386 | A1 * | 3/2009 | Jang et al. | 68/12.27 |
| 2009/0057117 | A1 * | 3/2009 | Jang et al. | 200/314 |
| 2009/0066205 | A1 * | 3/2009 | Park et al. | 312/228 |
| 2009/0153004 | A1 * | 6/2009 | Han et al. | 312/228 |
| 2009/0211307 | A1 * | 8/2009 | Park | 68/12.01 |
| 2009/0262553 | A1 * | 10/2009 | Kim | 362/619 |
| 2010/0043499 | A1 * | 2/2010 | Choi et al. | 68/13 R |
| 2010/0139329 | A1 * | 6/2010 | Yoon et al. | 68/139 |

FOREIGN PATENT DOCUMENTS

KR 10-2007-0066601 6/2007

* cited by examiner

*Primary Examiner* — Lisa Lea Edmonds

(74) *Attorney, Agent, or Firm* — Staas & Halsey LLP

(57) ABSTRACT

The control panel assembly includes a control panel provided with at least one hook, a guide member disposed at the inside of the control panel and provided with at least one hook reception part corresponding to the at least one hook, and an electronic component fixed to the inside of the guide member.

19 Claims, 9 Drawing Sheets

CONTROL PANEL ASSEMBLY AND WASHING MACHINE HAVING THE SAME

CROSS-REFERENCE TO RELATED APPLICATIONS

This application claims the benefit of Korean Patent Application No. 2009-0002924, filed on Jan. 14, 2009, in the Korean Intellectual Property Office, the disclosure of which is incorporated herein by reference.

BACKGROUND

1. Field

Embodiments of the present invention relate to a control panel assembly, in which knob assemblies are arranged at correct positions, and a washing machine having the control panel assembly.

2. Description of the Related Art

Washing machines are apparatuses, which wash clothes using electric power. In general, a washing machine includes a tub to contain washing water, and a drum rotatably installed in the tub. When the drum is rotated or a pulsator installed in the drum is rotated under the condition that laundry and washing water are put into the drum, the laundry rubs against the drum and the washing water and thus dirt is removed from the laundry.

The washing machine is generally provided with a control panel assembly on the upper end of the front surface of a main body forming the external appearance of the washing machine to control the operation of the washing machine.

The control panel assembly includes a control panel provided with at least one opening formed at one side thereof, and a circuit substrate attached to the rear surface of the control panel. Knob assemblies, each of which has a rotation knob and a push button, are provided on the control panel, and rotation switches respectively assembled with the rotation knobs are provided on the circuit board.

SUMMARY

Therefore, it is an aspect of the present invention to provide a control panel assembly, in which a guide member, to which an electronic component is connected, is fixed to a control panel to allow knob assembles to be arranged at correct positions of rotation switches, and a washing machine having the control panel assembly.

Additional aspects of the invention will be set forth in part in the description which follows and, in part, will be apparent from the description, or may be learned by practice of the invention.

In accordance with one aspect, a control panel assembly includes a control panel provided with at least one hook, a guide member disposed at the inside of the control panel and provided with at least one hook reception part corresponding to the at least one hook, and an electronic component fixed to the inside of the guide member.

The control panel assembly may further include knob assemblies installed through openings formed through the control panel, knob guides provided on the guide member to support the knob assemblies, and rotation switches provided on the electronic component and connected to the knob assemblies to select a function.

The control panel may be provided with an inclined manipulation surface.

When the electronic component is fixed to the guide member and the at least one hook of the control panel and the at least one hook reception part of the guide member are connected, the knob assemblies may be connected to the rotation switches through the openings of the control panel under the condition that the rotation switches are arranged.

The at least one hook may include first hooks provided at the edge of the rear surface of the control panel, and second hooks provided at the middle portion of the rear surface of the control panel.

First hook reception parts corresponding to the first hooks and second hook reception parts corresponding to the second hooks may be provided on the guide member.

The first and second hook reception parts may respectively include first and second hook holes, and the first and second hooks may respectively include first and second locking parts elastically deformed to be inserted into the first and second hook holes, and first and second seat parts, on which the first and second hook holes are respectively seated, when the first and second locking parts are respectively inserted into the first and second hook holes.

The first and second seat parts may be respectively movable within the first and second hook holes.

Each of the second hooks and each of the second hook reception parts may respectively further include a screw connection part and a screw hole, to which a screw is connected.

In accordance with another aspect, a control panel assembly includes knob assemblies connected to a control panel through openings of the control panel, at least one hook formed on the rear surface of the control panel, at least one hook reception part formed on a guide member corresponding to the at least one hook, and rotation switches protruding from a circuit board fixed to the guide member and connected to the knob assemblies.

The at least one hook may be movable within the at least one hook reception part to arrange the guide member and the circuit board.

The at least one hook may include first hooks formed at the edge of the control panel, and the at least one hook reception part may include first hook reception parts to respectively receive the first hooks.

The at least one hook may further include second hooks formed at the middle portion of the control panel, and the at least one hook reception part may further include second hook reception parts to respectively receive the second hooks.

In accordance with another aspect, a washing machine includes a control panel assembly to control the operation of the washing machine, the control panel assembly including a control panel provided with at least one hook, a guide member disposed at the inside of the control panel and provided with at least one hook reception part corresponding to the at least one hook, an electronic component fixed to the inside of the guide member, rotation switches rotatably installed on the electronic component to select a function, and knob assemblies passing through the control panel and respectively connected to the rotation switches.

The guide member may include knob guides to respectively support the knob assemblies.

The guide member and the electronic component may be integrally formed.

The electronic component may be mounted on a circuit board.

In accordance with a further aspect of the present invention, a washing machine includes a control panel assembly to control the operation of the washing machine, the control panel assembly including a control panel provided with at least one hook, a guide member provided with at least one hook reception part movably connected to the at least one hook, and knob assemblies passing through the control panel.

The guide member may be connected to the control panel in parallel.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
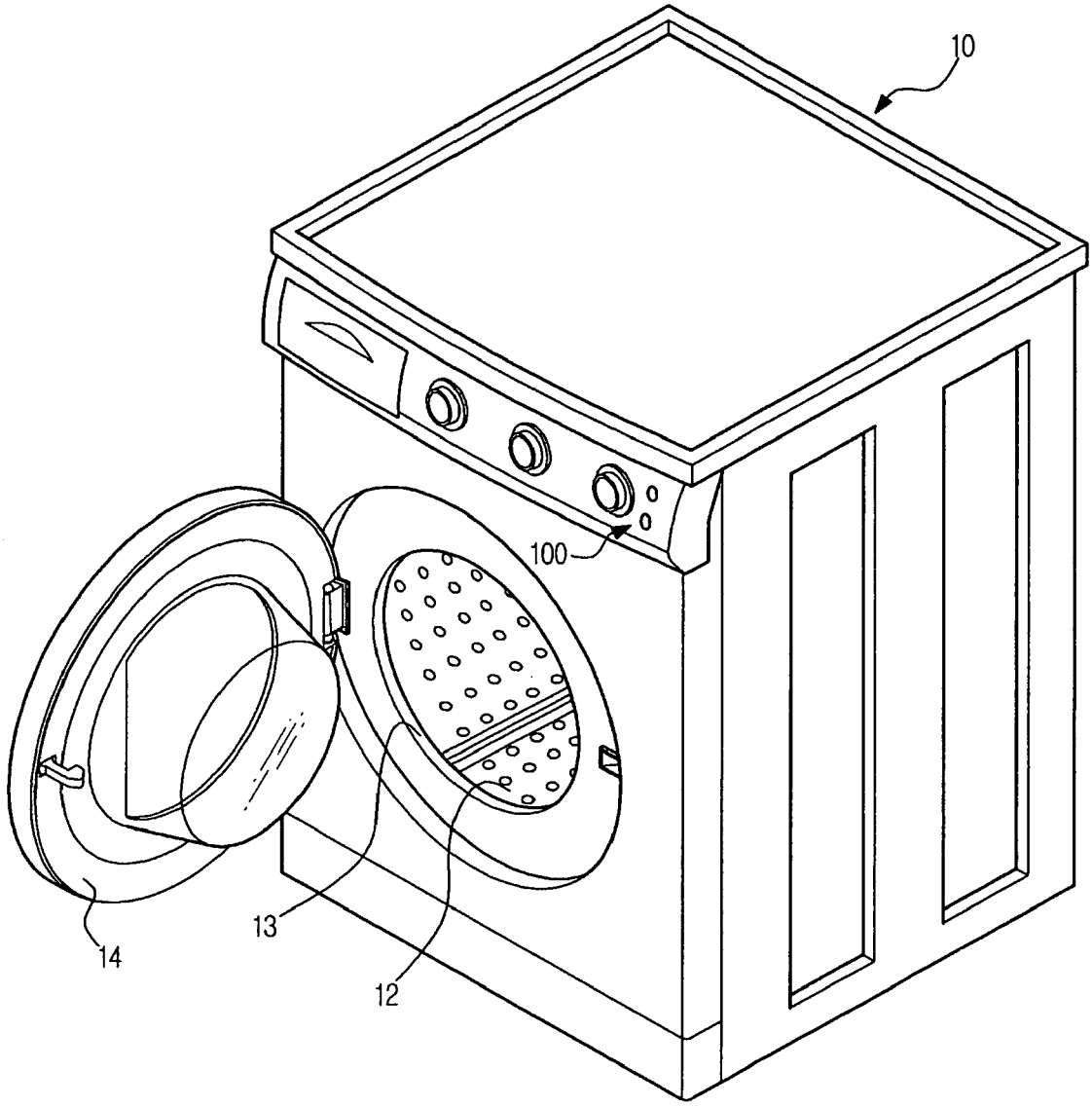
FIG. 1 is a perspective view illustrating a washing machine in accordance with an embodiment.

Reference will now be made in detail to the embodiments of the present invention, examples of which are illustrated in the accompanying drawings, wherein like reference numerals refer to the like elements throughout.

FIG. 1 is a perspective view illustrating a washing machine in accordance with an embodiment.

As shown in FIG. 1, the washing machine in accordance with the embodiment includes a main body 10 forming the external appearance of the washing machine, a tub (not shown) installed in the main body 10 to contain water, and a drum 12 rotatably installed in the tub (not shown) to wash laundry. An opening 13 is formed through the front surface of the main body 10 such that the laundry is put into the drum 12, and a door 14 to open and close the opening 13 is installed. A control panel assembly 100 to allow a user to control the operation of the washing machine is provided on the upper end of the front surface of the main body 10.

Figure 2:
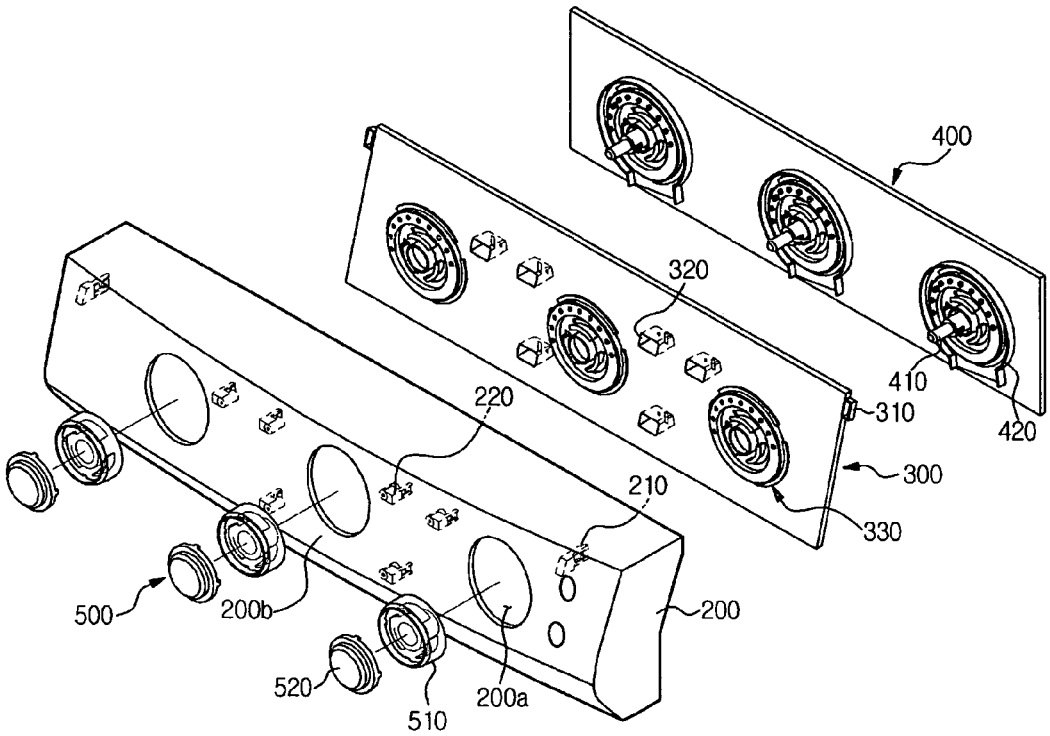
FIG. 2 is an exploded perspective view illustrating a control panel assembly of the washing machine in accordance with the embodiment.
Figure 3:
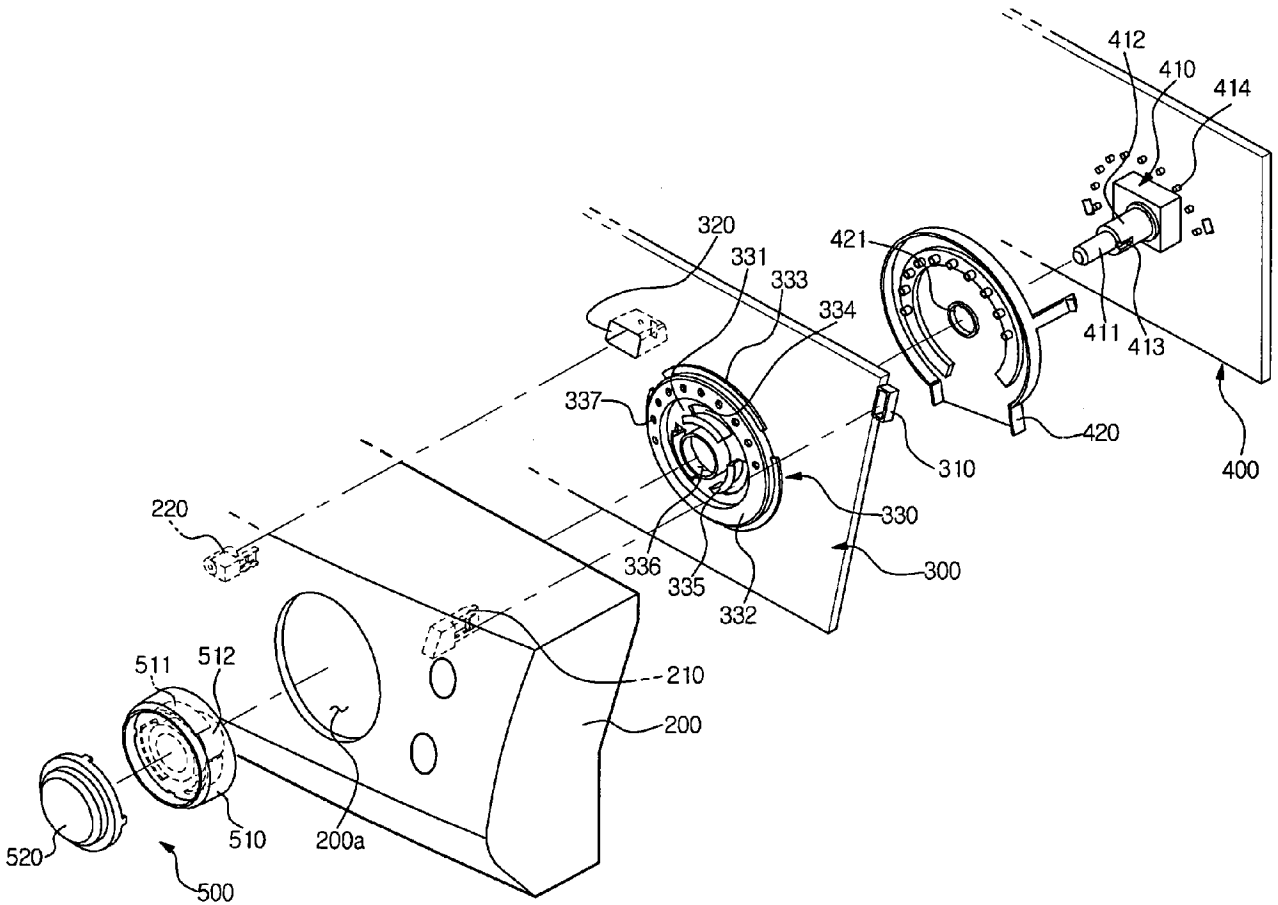
FIG. 3 is an enlarged view of a portion of FIG. 2.

FIG. 2 is an exploded perspective view illustrating the control panel assembly of the washing machine in accordance with the embodiment, and FIG. 3 is an enlarged view of a portion of FIG. 2.

As shown in FIGS. 2 and 3, the control panel assembly 100 in accordance with the embodiment of the present invention includes a control panel 200 provided with at least one opening 200*a* formed at one side thereof, a guide member 300 connected to the inside of the control panel 200, and an electronic component disposed at the inside of guide member 300 to control the operation of various devices in the washing machine to perform a function selected by a user.

The openings 200*a* to connect knob assemblies 500 disposed at the outside of the control panel 200 to the electronic component disposed at the inside of the guide member 300 are formed through the control panel 200. A manipulation surface 200*b* of the control panel 200 may be inclined for user convenience. The inside of the control panel 200 is hollowed such that the guide member 300 and the electronic component are installed in the control panel 200. Here, the electronic component is mounted on a circuit board 400, and the circuit board 400 provided with the electronic component is connected to the guide member 300.

At least one hook 210 and 220 protrudes from the rear surface of the control panel 200. The hook 210 and 220 allows the guide member 300, to which the circuit board 400 is connected, to be assembled with the control panel 200 such that the circuit board 400 is arranged at a correct position.

The hook 210 and 220 provided on the rear surface of the control panel 200 includes at least one first hook 210 disposed at the edge of the rear surface of the control panel 200, and at least one second hook 220 disposed at the inside of the at least one first hook 210.

Figure 4:
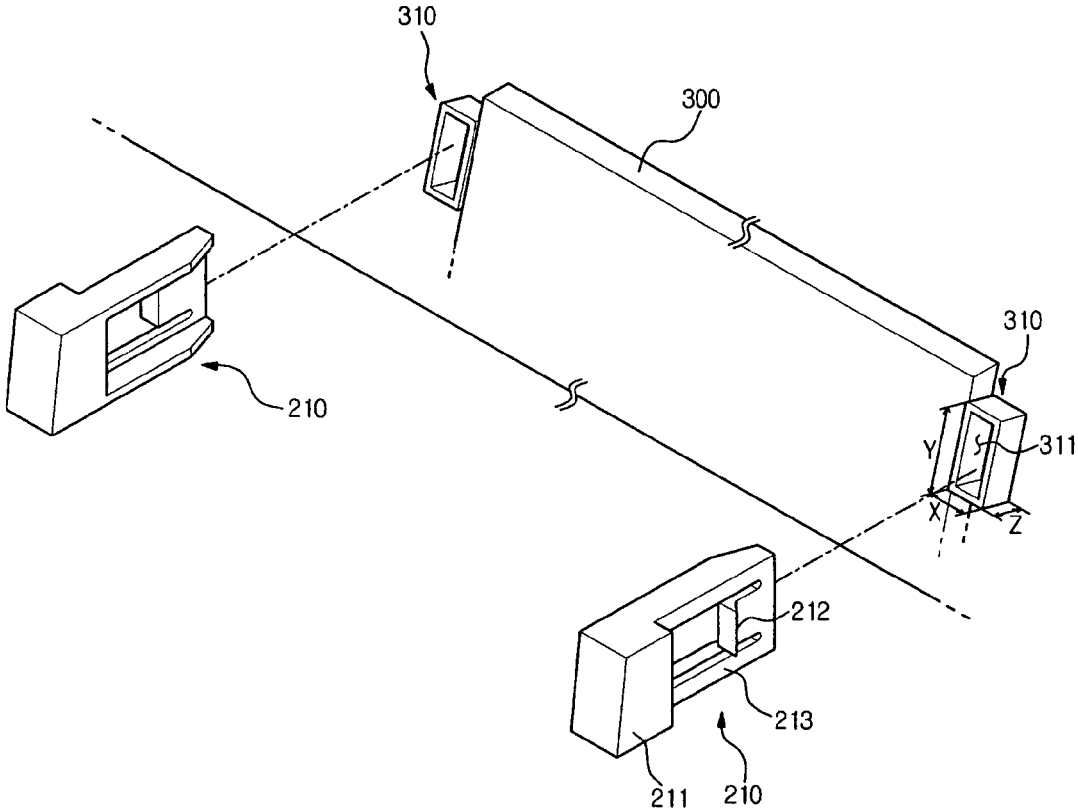
FIG. 4 is a view illustrating a process of fastening first hooks into first hook reception parts.

As shown in FIG. 4, the at least one first hook 210 is provided at the edge of the control panel 200, and serve to achieve first temporary assembly of the control panel 200 with the guide member 300. In this embodiment, the at least one first hook 210 include a first hook 210 provided at the left end of the control panel 200, and a first hook 210 provided at the right end of the control panel 200. After any one of the first hooks 210 provided at the left and right ends of the control panel 200 is firstly connected to the guide member 300, the other one of the first hooks 210 provided at the left and right ends of the control panel 200 is connected to the guide member 300.

Each of the first hooks 210 includes a support part 211 protruding from the rear surface of the control panel 200, a locking part 212 elastically deformed to restrict the guide member 300 or release the restriction of the guide member 300, and a seat part 213 formed between the support part 211 and the locking part 212.

The seat parts 213 of the first hooks 210 are respectively extended from the support parts 211 to have a relatively small size, and the guide member 300 is connected to the seat parts 213 by the elastic deformation of the locking parts 212 in a process of inserting the first hooks 210 into the guide member 300. Here, the seat parts 213 are movable such that a positional deviation is adjusted under the condition that the seat parts 213 are connected to the guide member 300.

Figure 5:
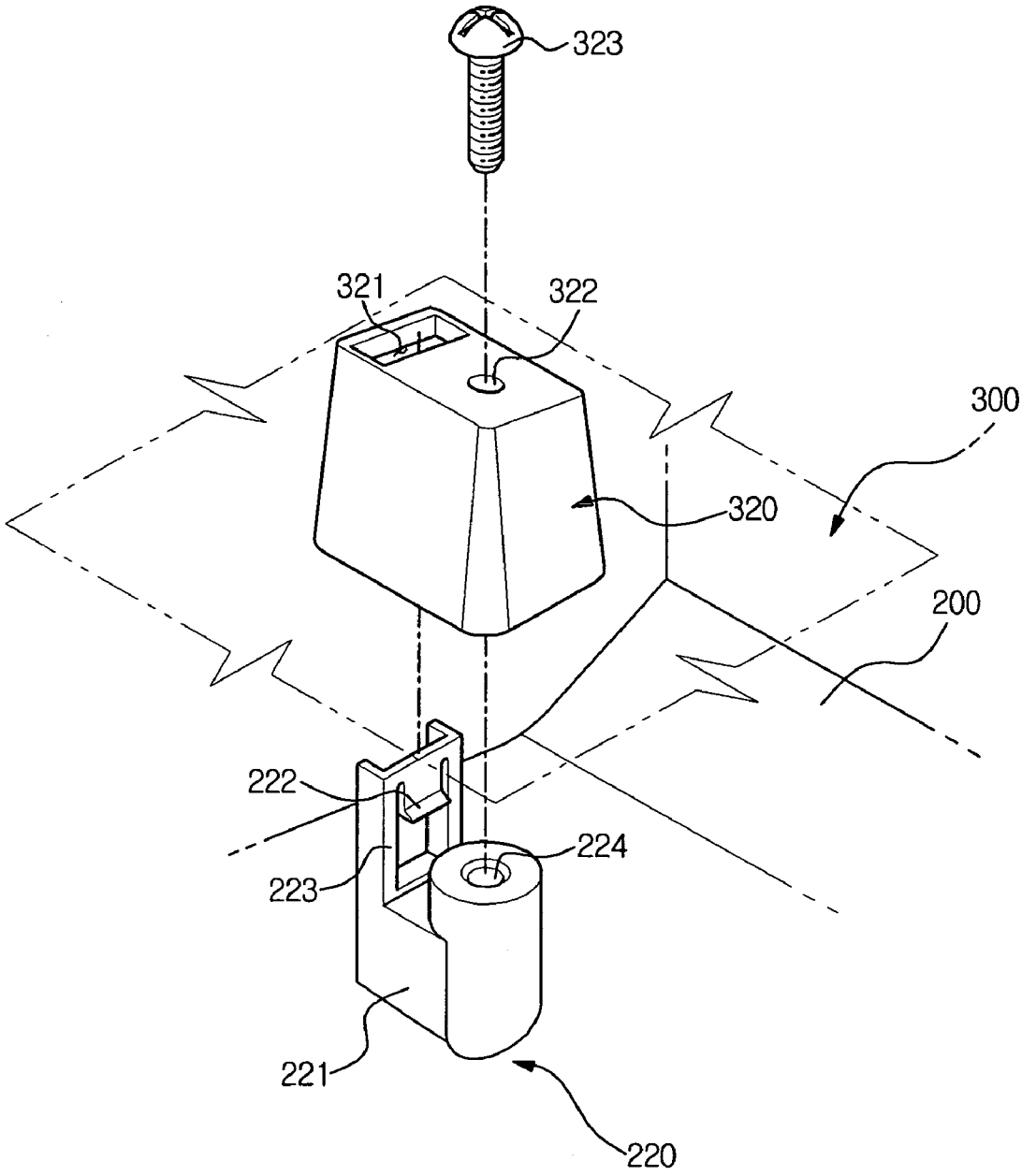
FIG. 5 is a view illustrating a process of fastening a second hook into a second hook reception part.

As shown in FIG. 5, the second hooks 220 are provided at the middle portion of the control panel 200 to achieve second temporary assembly of the control panel 200 with the guide member 300. In this embodiment, the second hooks 200 may be formed at the middle portion of the control panel 200 in plural number. Although the drawings illustrate that six second hooks 200 are provided and connected to the guide member 30, the number of the second hooks 200 may be varied according to the size of the control panel 200 and the guide member 300 and the number of the knob assemblies 500. Further, the number of the second hooks 200 may be at least one.

In the same manner as the first hooks 210, each of the second hooks 220 includes a support part 221 protruding from the rear surface of the control panel 200, a locking part 222 elastically deformed to restrict the guide member 300 or release the restriction of the guide member 300, and a seat part 223 formed between the support part 221 and the locking part 222. Each of the second hooks 200 further includes a screw connection part 224 extended from the support part 221 such that a screw 323 is connected to the screw connection part 224.

The seat parts 223 of the second hooks 220 are respectively extended from the support parts 221 to have a relatively small size, and the guide member 300 is seated on the seat parts 223 by the elastic deformation of the locking parts 222 in a process of inserting the second hooks 220 into the guide member 300. Here, the seat parts 223 of the second hooks 220 are movable such that a positional deviation is adjusted under the condition that the seat parts 223 are connected to the guide member 300. Therefore, after the temporary assembly of the control panel 200 and the guide member 300 by the first hooks 210 and the second hooks 220 has been completed, the main assembly of the control panel 200 and the guide member 300 may be completed by adjusting the positions of the seat parts 213 and 223 due to the relative movement of the seat parts 213 and 223 and inserting the screws 323 into the screw connection parts 224 of the second hooks 220.

The knob assemblies 500 are provided at the outside of the control panel 200. Each of the knob assemblies 500 includes a rotation knob 510 rotatably mounted on a knob guide 330 of the guide member 300, and a push button 520 disposed on the upper surface of the rotation knob 510.

As shown in FIGS. 2 and 3, the guide member 300, to which the circuit board 400 is connected, is provided at the inside of the control panel 200. The inside of the guide member 300 is hollowed such that the circuit board 400 is seated in the guide member 300. Particularly, the guide member 300 guides the circuit board 400 such that the circuit board 400 is easily assembled with and disassembled from the control panel 200, when the manipulation surface 200*b* of the control panel 200 has an inclined structure for user convenience.

The knob guides 330 are installed on the guide member 300. The knob guides 330 support the knob assemblies 500 and thus prevent the movement of the knob assemblies 500, and display a function, selected by a user through the rotating or pushing operation of the knob assemblies 500, to the user.

Each of the knob guides 330 includes a base panel 331, on which the knob assembly 500 is mounted, a circular display panel 332 provided around the base panel 331, and a locking protrusion 333 protruding along the circumference of the display panel 332. Letters or marks are printed on the display panel 332 such that a user recognizes the function selected through the knob assembly 500, and the display panel 332 is provided with light transmission parts 337, which transmit light irradiated from an LED of the circuit board 400 forward. The locking protrusion 333 causes the knob guide 330 to be locked with the circumference of the opening 200*a*, when the knob guide 330 is installed on the control panel 200. Drain holes 334 to drain water entering the base panel 331 from the outside may be formed through the base panel 331.

At least one hook reception part 310 and 320, which is respectively connected to the at least one first hook 210 and 220 of the control panel 200, is provided on the guide member 300, thereby allowing the circuit board 400 and the control panel 200 to be assembled.

The hook reception part 310 and 320 provided on the guide member 300 includes first hook reception parts 310 connected with the first hooks 210 of the control panel 200, and second hook reception parts 320 connected with the second hooks 220 of the control panel 200.

The first hook reception parts 310 are provided at both ends of the guide member 300 corresponding to the first hooks 210. That is, the first hook reception parts 310 are provided at the left and right ends of the guide member 300 in plural number.

Figure 6A:
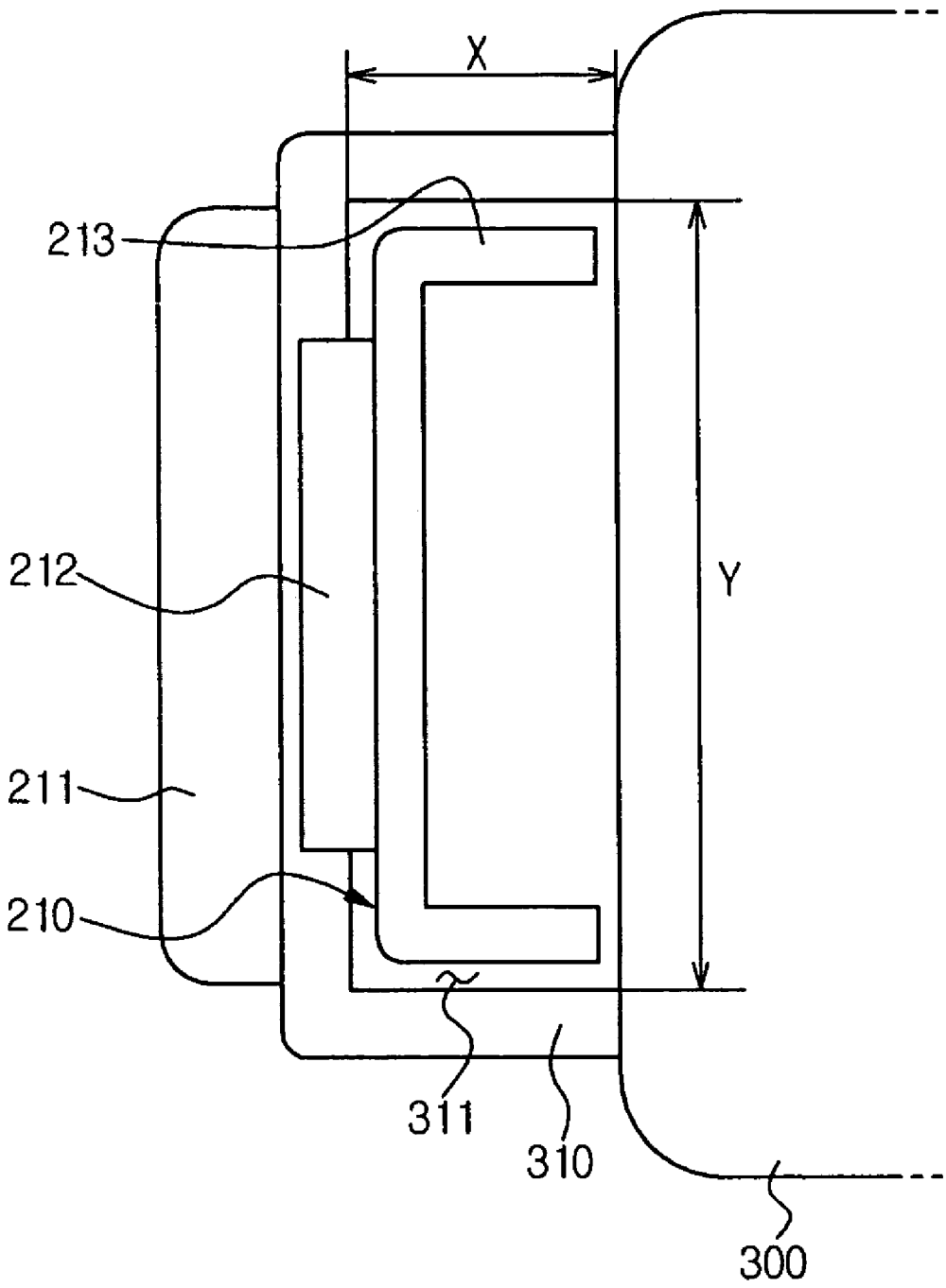
FIG. 6A is a plan view illustrating the fastened state of the first hook into the first hook reception part.
Figure 6B:
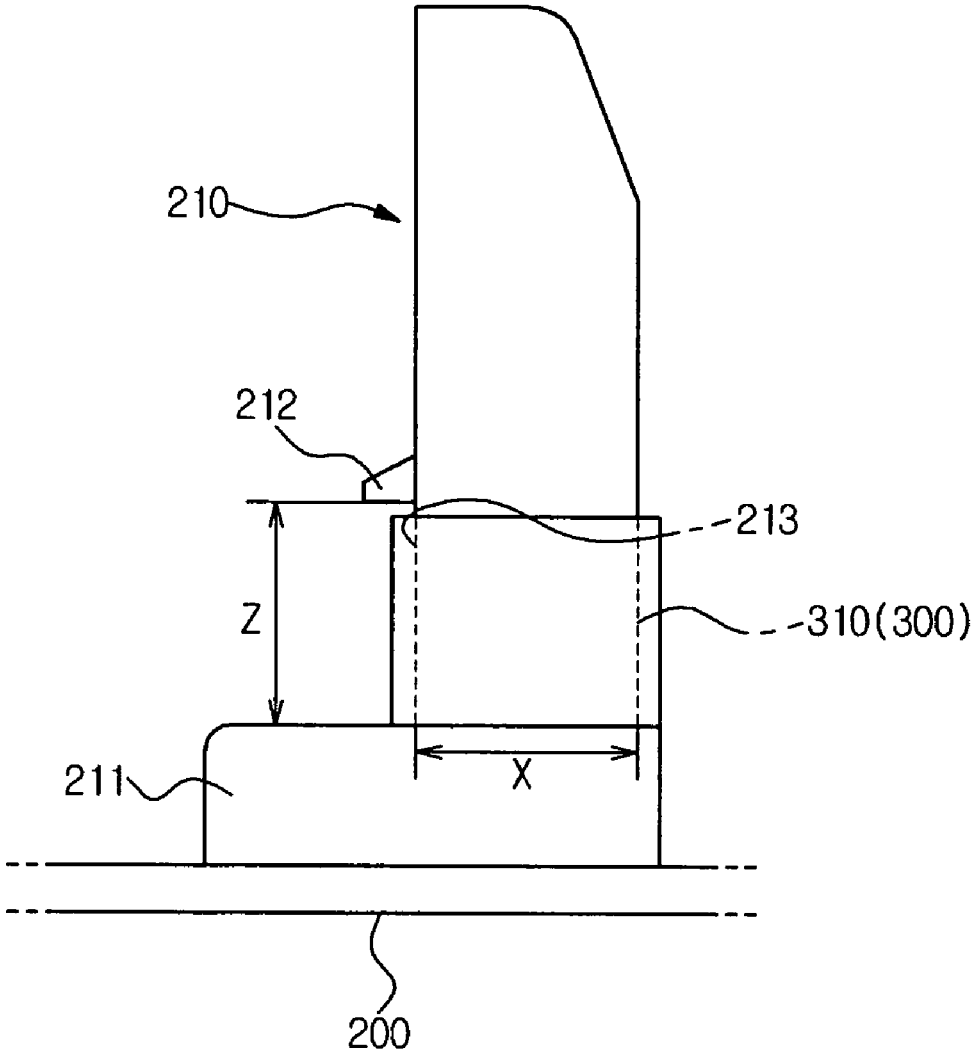
FIG. 6B is a side view illustrating the fastened state of the first hook into the first hook reception part.

As shown in FIGS. 6A and 6B, each of the first hook reception parts 310 includes a first hook hole 311, into which the first hook 210 is inserted. The lengths of the first hook hole 311 in the directions of the X and Y axes are longer than those of the first hook 210. Further, the length of the first hook hole 311 in the direction of the Z axis is longer than the length of the seat part 213 of the first hook 210. That is, the first hook 210 is movable in the directions of the X, Y, and Z axes under the condition that the first hook 210 is connected to the first hook reception part 310, and properly adjusts an interval between the control panel 200 and the guide member 300 due to a positional deviation. Therefore, the interval between the control panel 200 and the circuit board 400 is adjusted to maintain predetermined positions thereof, and thus the control panel 200 and the circuit board 400 are arranged at correct positions.

Figure 7A:
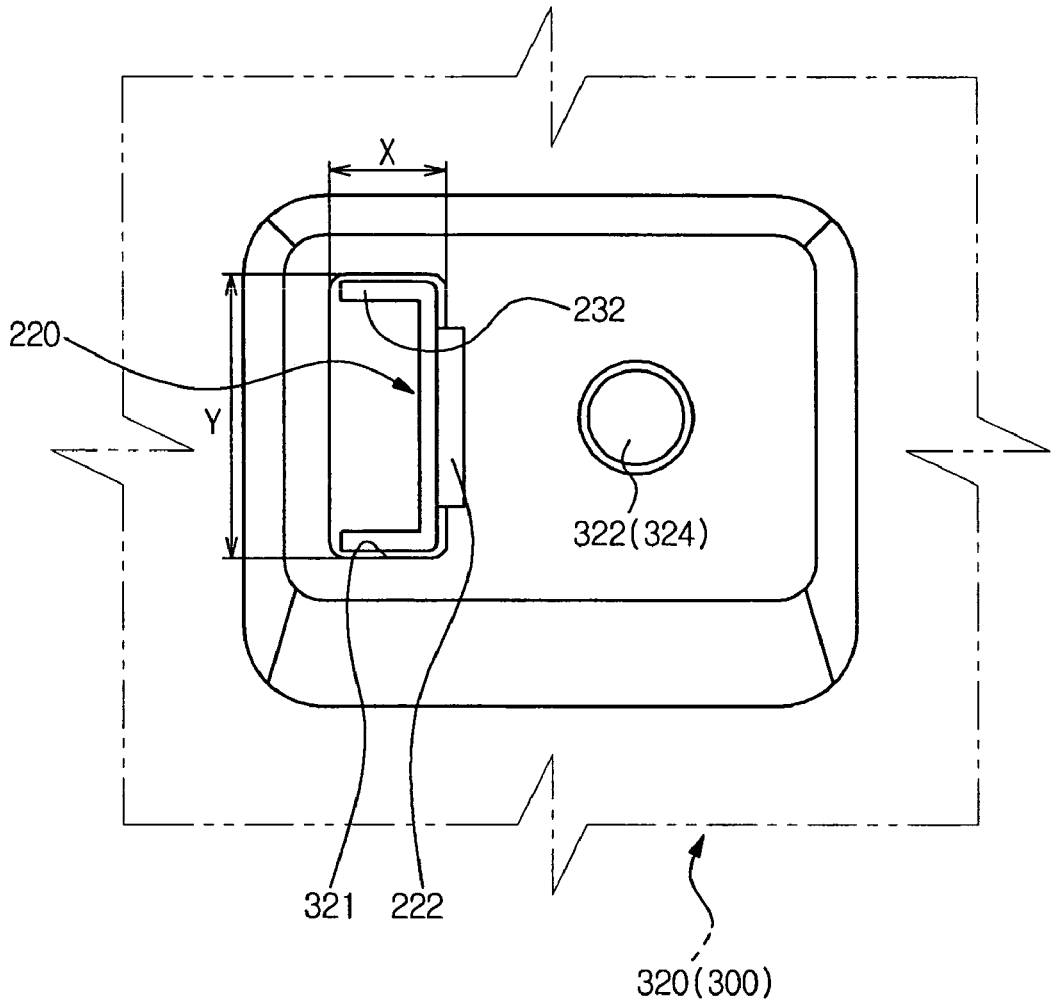
FIG. 7A is a plan view illustrating the fastened state of the second hook into the second hook reception part.
Figure 7B:
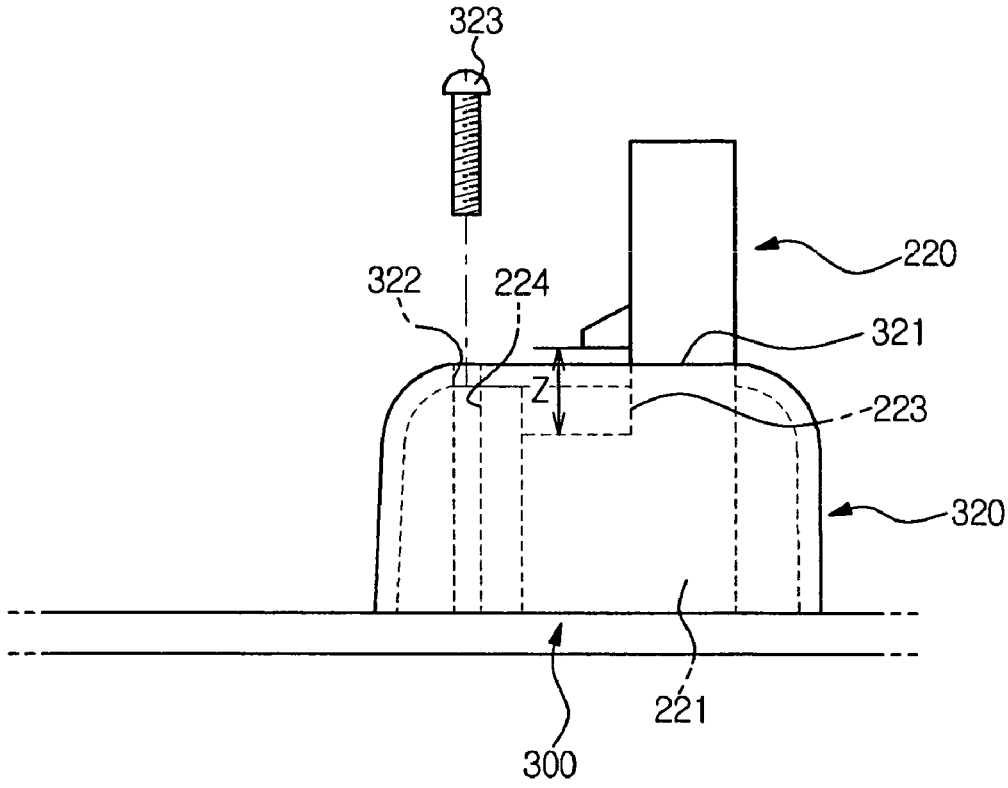
FIG. 7B is a side view illustrating the fastened state of the second hook into the second hook reception part.

As shown in FIGS. 7A and 7B, the second hook reception parts 320 are formed in a depression shape at the middle portion of the guide member 300. Each of the second hook reception parts 320 includes a second hook hole 321, into which the second hook 220 is inserted. In a process of inserting the second hook 220 into the second hook hole 321, the locking part 212 of the second hook 220 is elastically deformed so that the second hook hole 321 is seated on the seat part 213. Each of the second hook reception parts 320 includes a screw hole 322 formed at a position corresponding to the screw connection part 224 of the second hook 220.

The lengths of the second hook hole 321 in the directions of the X and Y axes are longer than those of the second hook 220. Further, the length of the second hook hole 321 in the direction of the Z axis is longer than the length of the seat part 223 of the second hook 220. Therefore, the second hook hole 321 is movable in the directions of the X, Y, and Z axes under the condition that the second hook hole 321 is connected to the second hook 220, and properly adjusts an interval between the control panel 200 and the guide member 300 due to a positional deviation. Therefore, the interval between the control panel 200 and the circuit board 400 is adjusted to maintain predetermined positions thereof, and thus the control panel 200 and the circuit board 400 are arranged at correct positions. Thereafter, main assembly of the control panel 200 and the guide member 300 is completed by connecting the screw connection parts 224 of the second hooks 220 and the screw holes 322 through the screws 323.

As shown in FIGS. 2 and 3, rotation switches 410 are installed on the circuit board 400, and a plurality of LEDs 414 is formed around each of the rotation switches 410.

Each of the rotation switches 410 includes a push shaft 411 protruding forward, and a rotary shaft 412 surrounding the lower portion of the push shaft 411. The knob assemblies 500, each of which includes the rotation knob 510 and the push button 520, are respectively assembled with the rotation switches 410. A user rotates the rotary shaft 412 of the rotation switch 410 or pushes the push shaft 411 of the rotation switch 410 through the rotation knob 510 and the push button 520, thereby selecting a function, such as a washing course or a washing time.

Encoder brackets 420, which protect the LEDs 414 and guide light irradiated from the LEDs 414 forward, are installed on the circuit board 400. A through hole 421, through which the rotary shaft 412 and the push shaft 411 of each of the rotation switches 410 pass, is formed through the center of each of the encoder brackets 420.

Each of the rotation knobs 510 is provided with a connection part 511 connected with each of the knob guides 330, and each of the knob guides 330 is provided with a restriction part 335 to restrict the connection part 511. The connection part 511 and the restriction part 335 allow the rotation knob 510 to be rotatably mounted on the knob guide 330, and prevent the rotation knob 510 from being separated from the knob guide 330 when a user pulls the rotation knob 510.

A boss 512 formed on the rotation knob 510 is provided with a connection protrusion (not shown) connected with the rotary shaft 412 of the rotation switch 410. The connection protrusion (not shown) is connected to a connection groove 413 of the rotary shaft 412 when the rotary shaft 412 of the rotation switch 410 is inserted into the rotation knob 510. The push button 520 is inserted into the boss 512, and the push button 520 inserted into the boss 512 is connected to the push shaft 411 of the rotation switch 410. Therefore, a user operates the rotation switch 410 by rotating the rotation knob 510 or pushing the push button 520, and thus selects a desired function.

Hereinafter, a process of assembling the control panel assembly of the washing machine in accordance with the embodiment of the present invention will be described.

First, the circuit board 400 is fixed to the guide member 300 by inserting the rotation switches 410 of the circuit board 400 into insertion holes 336 of the guide member 600. Thereafter, in order to achieve temporary assembly of the guide member 300 with the control panel 200, any one first hook 210 provided at one side end of the control panel 200 is inserted into any one first hook hole 311 of the guide member 300 by applying pressure. Then, the other first hook 210 provided at the other side end of the control panel 200 is inserted into the other first hook hole 311 by applying pressure. Thereby, the edge of the control panel 200 and the edge of the guide member 300 are firstly temporarily assembled.

Thereafter, the plurality of the second hooks 200 formed at the middle portion of the control panel 200 is inserted into the plurality of the second hook holes 321 provided at the guide member 300 by applying pressure, and thereby the middle portion of the control panel 200 and the middle portion of the guide member 300 are secondarily temporarily assembled.

In this case, since the guide member 300 moves in any one direction out of the directions of the X, Y, and Z axes according to the relative sizes of the first and second hooks 210 and 220 and the first and second hook holes 311 and 321 under the condition that the temporary assembly of the control panel 200 and the guide members 300 has been completed, the interval between the control panel 200 and the guide member 300 according to a positional deviation is properly adjusted. Therefore, the interval between the control panel 200 and the circuit board 400 is adjusted to maintain predetermined positions thereof, and thus the centers of the rotation switches 410 and the centers of the knob assemblies 500 coincide with each other.

Thereafter, the screws 323 are connected to the screw connection parts 224 of the second hooks 220 and the screw holes 322 of the second hook reception parts 320, and thus the guide member 300 is fixed to the control panel 200, thereby completing the assembly of the control panel assembly 100. Therefore, although a plurality of the knob assemblies 500 are connected to the control panel 200, the positional deviation is adjusted in the assembly process of the control panel 200 and the guide member 300, and thus it may be possible to prevent the lowering of the quality of the external appearance of the control panel assembly 100 generated due to non-coincidence between the centers of the rotation switches 410 and the centers of the knob assemblies 500.

As is apparent from the above description, the washing machine in accordance with the embodiment of the present invention achieves position adjustment by temporary assembly through hook connection between the control panel and the electronic component, and thus allows the knob assemblies and the rotation switches to be arranged at correct positions.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control panel assembly comprising:

a control panel provided with at least one hook;

a guide member disposed at the inside of the control panel and provided with at least one hook reception part corresponding to the at least one hook; and an electronic component fixed to the inside of the guide member, wherein the hook is movable under the condition that the hook is connected to the hook reception part such that an interval between the control panel and the guide member is adjustable.

2. The control panel assembly according to claim 1, further comprising:

knob assemblies installed through openings formed through the control panel;

knob guides provided on the guide member to support the knob assemblies; and rotation switches provided on the electronic component and connected to the knob assemblies to select a function.

3. The control panel assembly according to claim 1, wherein the control panel is provided with an inclined manipulation surface.

4. The control panel assembly according to claim 2, wherein when the electronic component is fixed to the guide member and the at least one hook of the control panel and the at least one hook reception part of the guide member are connected, the knob assemblies are connected to the rotation switches through the openings of the control panel under the condition that the rotation switches are arranged.

5. The control panel assembly according to claim 2, wherein the at least one hook includes first hooks provided at the edge of the rear surface of the control panel, and second hooks provided at the middle portion of the rear surface of the control panel.

6. The control panel assembly according to claim 5, wherein first hook reception parts corresponding to the first hooks and second hook reception parts corresponding to the second hooks are provided on the guide member.

7. The control panel assembly according to claim 6, wherein:

the first and second hook reception parts respectively include first and second hook holes; and the first and second hooks respectively include first and second locking parts elastically deformed to be inserted into the first and second hook holes, and first and second seat parts, on which the first and second hook holes are respectively seated, when the first and second locking parts are respectively inserted into the first and second hook holes.

8. The control panel assembly according to claim 7, wherein the first and second seat parts are respectively movable within the first and second hook holes.

9. The control panel assembly according to claim 7, wherein each of the second hooks and each of the second hook reception parts respectively further include a screw connection part and a screw hole, to which a screw is connected.

10. A control panel assembly comprising:

knob assemblies connected to a control panel through openings of the control panel;

at least one hook formed on the rear surface of the control panel;

at least one hook reception part formed on a guide member corresponding to the at least one hook; and rotation switches protruding from a circuit board fixed to the guide member and connected to the knob assemblies.

11. The control panel assembly according to claim 10, wherein the at least one hook is movable within the at least one hook reception part to arrange the guide member and the circuit board.

12. The control panel assembly according to claim 10, wherein:

the at least one hook includes first hooks formed at the edge of the control panel; and the at least one hook reception part includes first hook reception parts to respectively receive the first hooks.

13. The control panel assembly according to claim 12, wherein:

the at least one hook further includes second hooks formed at the middle portion of the control panel; and the at least one hook reception part further includes second hook reception parts to respectively receive the second hooks.

14. A washing machine having a control panel assembly to control the operation of the washing machine, the control panel assembly comprising:

a control panel provided with at least one hook;

a guide member disposed at the inside of the control panel and provided with at least one hook reception part corresponding to the at least one hook;

an electronic component fixed to the inside of the guide member;

rotation switches rotatably installed on the electronic component to select a function; and knob assemblies passing through the control panel and respectively connected to the rotation switches.

15. The washing machine according to claim 14, wherein the guide member includes knob guides to respectively support the knob assemblies.

16. The washing machine according to claim 14, wherein the guide member and the electronic component are integrally formed.

17. The washing machine according to claim 14, wherein the electronic component is mounted on a circuit board.

18. A washing machine having a control panel assembly to control the operation of the washing machine, the control panel assembly comprising:

a control panel provided with at least one hook;

a guide member provided with at least one hook reception part movably connected to the at least one hook and with an inclined manipulation surface; and knob assemblies passing through the control panel.

19. The washing machine according to claim 18, wherein the guide member is connected to the control panel in parallel.

* * * * *